US005558197A

United States Patent [19]

Rothschild et al.

[11] Patent Number: 5,558,197

[45] Date of Patent: Sep. 24, 1996

[54] COIN ESCALATOR FOR GAMING DEVICES

[75] Inventors: Wayne H. Rothschild, Wheeling; Edward J. Soyka, Rolling Meadows; Herbert H. Hausman, Lincolnshire; Joe Pirzadeh, Schaumburg, all of Ill.

[73] Assignee: WMS Gaming, Inc., Chicago, Ill.

[21] Appl. No.: 283,384

[22] Filed: Jul. 29, 1994

[51] Int. Cl.[6] ..... G07F 1/04

[52] U.S. Cl. ..... 194/344; 453/57

[58] Field of Search ..... 194/344, 338, 194/334; 453/9, 32, 57; 221/267

[56] References Cited

U.S. PATENT DOCUMENTS

| | | | |
|---|---|---|---|
| 2,122,550 | 7/1938 | Adrian | 453/9 X |
| 5,046,989 | 9/1991 | Dass | 194/344 X |
| 5,066,261 | 11/1991 | Parham | 221/267 X |
| 5,232,398 | 8/1993 | Maki | 453/57 |

FOREIGN PATENT DOCUMENTS

| | | |
|---|---|---|
| 0469886 | 2/1992 | European Pat. Off. . |
| WO9110974 | 7/1991 | WIPO . |

*Primary Examiner*—F. J. Bartuska
*Attorney, Agent, or Firm*—Rockey, Rifkin and Ryther

[57] ABSTRACT

The improved coin escalator of the invention includes a smoothly curved coin transport channel positioned on the outside circumference of an arcuate back plate. The channel is defined by spacer plates which are attached to the outer curved surface of the back plate and edge plates integral with the spacer plates. Downtime of the gaming device is minimized because the smoothly curved shape of the transport channel prevents coins from becoming jammed therein.

2 Claims, 3 Drawing Sheets

COIN ESCALATOR FOR GAMING DEVICES

BACKGROUND AND SUMMARY OF THE INVENTION

The present invention generally relates to the handling of coins in gaming devices and, more particularly, to an improved coin escalator for transporting coins from a payout hopper in a gaming device to a payout trough positioned above the hopper on the device. Gaming devices typically consist of a cabinet supporting a video screen which displays a game as directed by the game program associated with a computer control system. Alternatively, the cabinet could support a plurality of reels, such as those commonly found on slot machines. The player manipulates buttons provided on the cabinet to play the game in an attempt to win a payout.

Gaming devices typically are provided with a coin hopper which is capable of storing coins deposited by game players and driving stored coins into a coin escalator. The escalator transports coins which are driven into it to a payout trough which normally is disposed at a point above the coin hopper. A coin counter, associated with the escalator, signals the computer control system the amount of coins that have been dispensed to the player.

Typically, the coins travel on the curved inner surface of the escalator past a transition point of unequal radius. On existing escalators, the coins often "shingle," that is the edges of adjacent coins become overlapped thereby jamming the device. One solution to this problem is to provide a plurality of spring loaded bearings or other means at the abrupt transition to prevent or reduce shingling. These solutions unnecessarily increase the costs of manufacturing coin escalators and are not a foolproof solution. Thus, an improved coin escalator is desired in which the risk of coin "shingling" is minimized.

Coin shingling is minimized in the present invention by the use of a smoothly curved coin transport channel positioned on the outer surface of the escalator. Because there are no abrupt transitions, the likelihood of coins jamming in the escalator during transport is minimized.

DETAILED DESCRIPTION OF A PREFERRED EMBODIMENT

Figure 1:
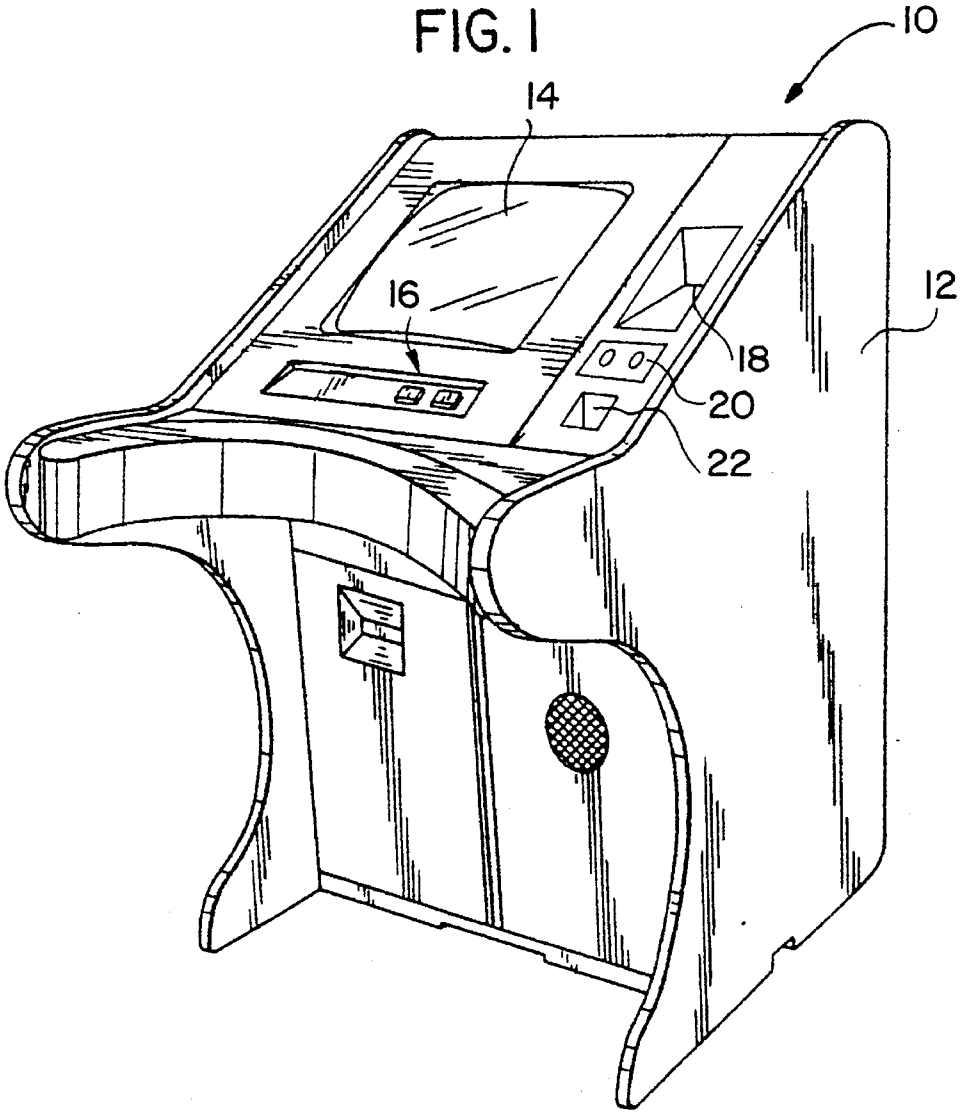
FIG. 1 shows a perspective view of a gaming device suitable for use with the present invention.

Referring to FIG. 1, a perspective view of a gaming device 10 which incorporates the present invention is illustrated. Gaming device 10 includes a cabinet 12 which supports a video screen 14 and a plurality of switch or touch screen control buttons 16 that are manipulated by the player to control play of the game. Alternatively, video screen 14 could be replaced by a plurality of mechanical reels or the like for use as a slot machine.

Gaming machine 10 includes a bill entry 18 and coin slots 20. Coin slots 20 serve to deliver the inserted coins into a hopper 24 (FIG. 2) and bill entry 18 delivers the inserted bills into a bill validator and stacker (not shown). If a player wins and wishes to cash out, then the payoff is deposited into payout trough 22 as discussed hereafter. Typically, a coin escalator 26 is used to transport coins from hopper 24 to payout trough 22 via delivering arm 28 (FIG. 2).

Figure 2:
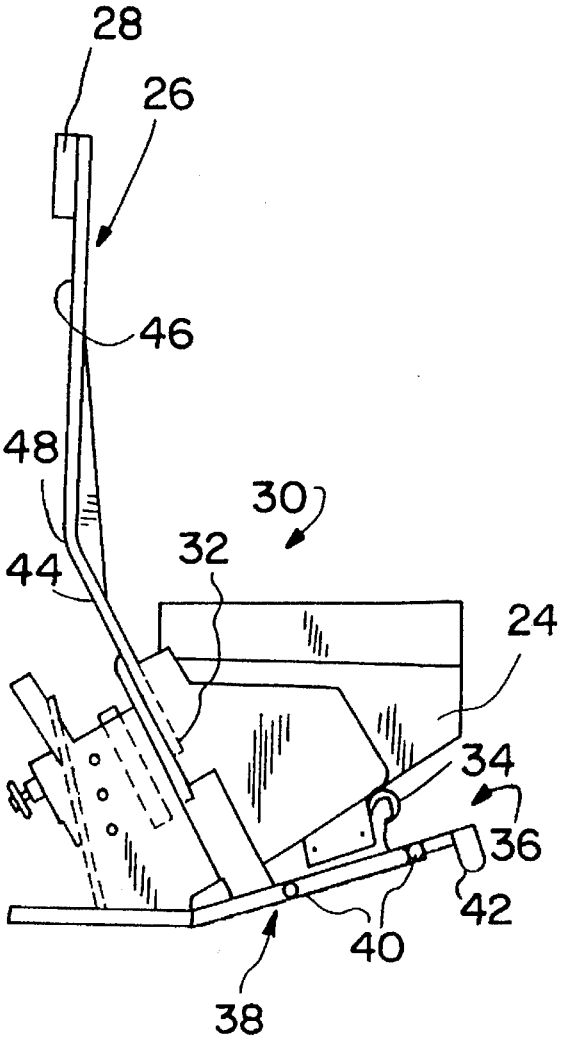
FIG. 2 PRIOR ART
FIG. 2 illustrates a prior art coin hopper and escalator assembly.

Referring to FIG. 2, a prior art coin escalator and hopper combination is illustrated. Coin hopper 24 is open at its top 30 to receive coins deposited into coin slots 20 and is removably secured to escalator 26 by bracket 32. Hopper 24 and escalator 26 are supported on mounting sled 36. Sled 36 includes a frame 38 supported on a plurality of rollers 40 and 42 which engage with a suitable mounting structure on the bottom of cabinet 12 to correctly orient the hopper 24 therein. Alternatively, the hopper 24 and escalator 26 could be attached to a mounting plate in the bottom of cabinet 12.

A coin transport path is defined along the inside arc of escalator 26. Escalator 26 is connected to the payout trough 22 via delivering arm 28 to convey coins from hopper 24 to the payout trough. Due to the abrupt change of direction at the junction 48 of the lower escalator portion 44 and upper portion 46, coins tend to jam or become shingled.

Figure 2A:
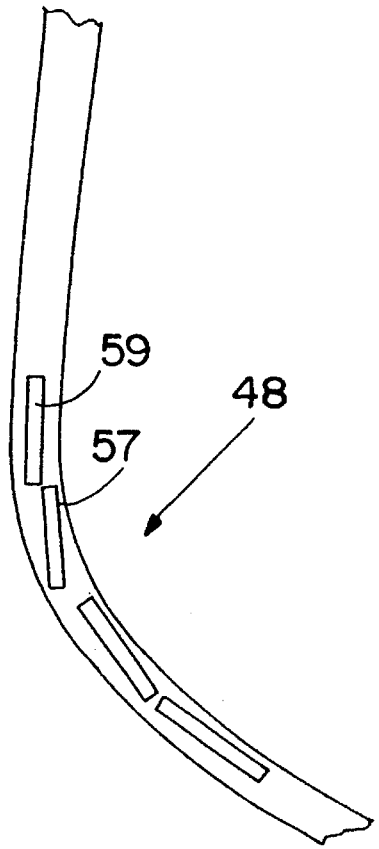
FIG. 2A PRIOR ART
FIG. 2A is an enlargement of a portion of the coin escalator of FIG. 2.

FIG. 2A is an enlargement of the junction 48 in escalator 26 where coins frequently become jammed. For example, coins 57 and 59 are shingled and block the transport path in escalator 26 because their edges are overlapped. Down time of the gaming machine is increased because a coin jam has to be manually released. A typical solution to this problem, although not foolproof, is to provide a plurality of spring loaded bearings at juncture 48 to reduce the shingling effect by guiding the coins past the transition.

Figure 3:
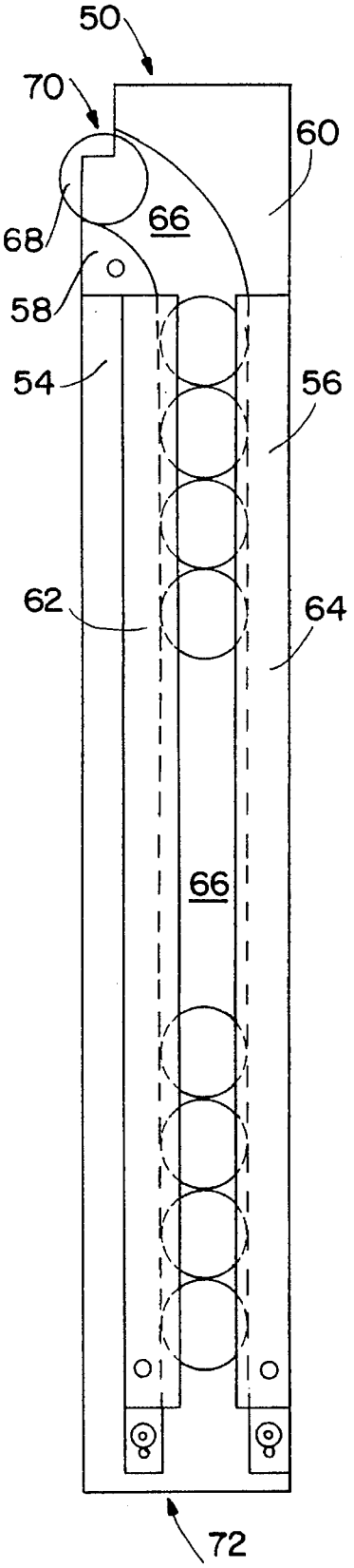
FIG. 3 is a rear view of the improved coin escalator of the invention.
Figure 4:
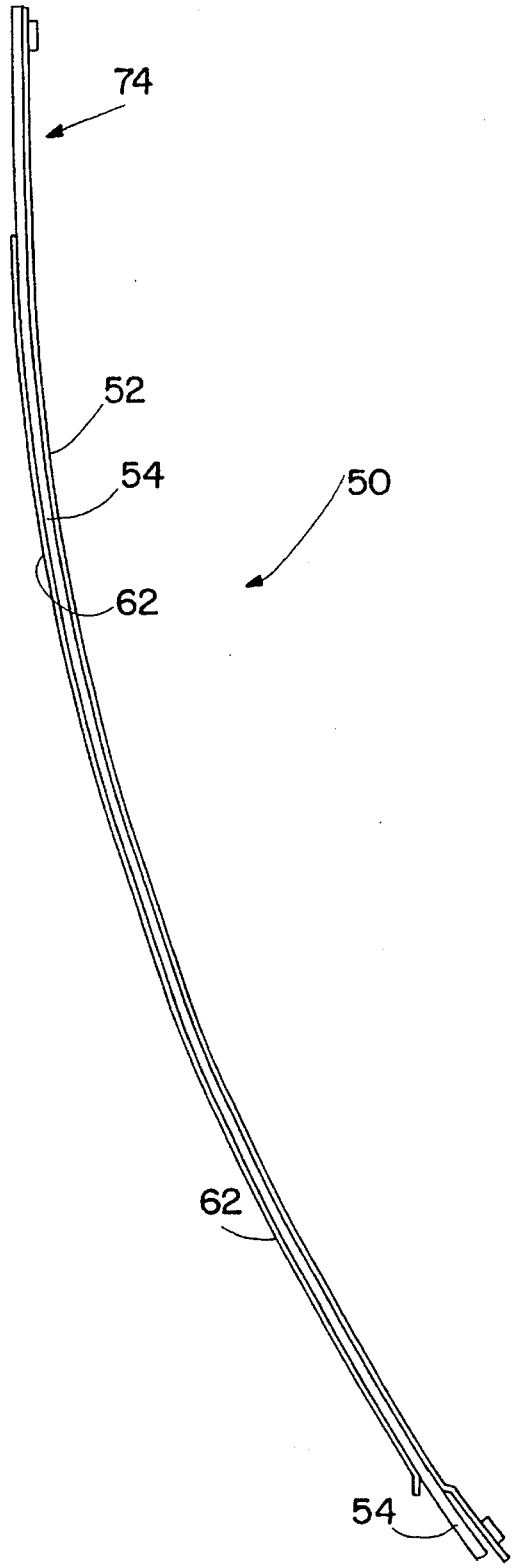
FIG. 4 is a side view of the improved coin escalator of the invention.

Referring to FIGS. 3 and 4, the improved coin escalator 50 of the invention is illustrated. A smoothly curved coin transport channel 66, without any abrupt transitions, is positioned on the outside surface of arcuate back plate 52. Channel 66 is defined by arcuate back plate 52, spacer plate 54 and edge plate 62, and spacer plate 56 and edge plate 64. Spacer plate and edge plate pairs 54 and 62 and 56 and 64 preferably are a single element, although separate spacer and edge plates could utilized. Channel 66 has a width which is slightly greater than the diameter of the coins for which it is designed and has a depth which is slightly larger than the thickness of such coins.

First and second upper guides 58 and 60 are attached at the top of back plate 52 to direct coins, such as coin 68, into the payout trough 22 via conventional means such as the counter arm 28 of FIG. 2. In operation, coins are received from hopper 24 at end 72 via a conventional coin mechanism, travel up coin channel 66 on the outside of back plate 52 and are discharged into coin trough 22 at end 74. A conventional switch means (not shown), such as an optical switch, is provided at notch 70 (FIG. 3) to count the number of coins dispensed into trough 22.

As seen in FIG. 4, escalator 50 is arcuate in shape such that coin transport channel 66 contains no abrupt transitions where coins could jam or become shingled. The coin path 66 may be shaped as illustrated because coins travel up escalator 50 on the outside circumference of back plate 52. Thus, there is no need to include spring loaded bearings or other anti-jam arrangements to facilitate coin travel.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A coin escalator for conveying coins from a coin hopper to a discharge point comprising:

a) an arcuate back plate having a smooth, continuous coin-guiding surface on its outer circumference for guiding the coins, the coin-guiding surface extending without interruption along the entire length of the back plate and having a width at least equal to the diameter of the coins;

b) a pair of spacer plates disposed on the back plate, each spacer plate including an edge plate, the edge plates extending substantially parallel to the coin-guiding surface and being spaced therefrom a distance at least equal to the thickness of the coins to define a coin transport channel with the coin-guiding surface, the coin-guiding surface extending continuously between the spacer plates;

whereby the coins travel along the outer circumference of the back plate.

2. In combination with a gaming device having a payoff hopper for storing coins and a payout chute having an input opening disposed at a position above the payoff hopper, a coin escalator for conveying coins from the hopper to the payout chute comprising:

a) an arcuate back plate having a smooth, continuous coin-guiding surface on its outer circumference for guiding the coins, the coin-guiding surface extending without interruption along the entire length of the back plate and having a width at least equal to the diameter of the coins;

b) a pair of spacer plates disposed on the outer circumference of the back plate, each spacer plate including an edge plate, the edge plates extending substantially parallel to the coin-guiding surface and being spaced therefrom a distance at least equal to the thickness of the coins to define a coin transport channel with the coin-guiding surface, the coin-guiding surface extending continuously between the spacer plates;

whereby the coins travel along the outer circumference of the back plate.

* * * * *